United States Patent [19]

Mogensen

[11] 4,257,882

[45] Mar. 24, 1981

[54] METHOD OF PRE-CONCENTRATING HETEROGENEOUS MINERAL MIXTURES

[75] Inventor: Fredrik K. Mogensen, Hjo, Sweden

[73] Assignee: Kommanditbolaget Fredrik Mogensen & Co., Hjo, Sweden

[21] Appl. No.: 901,240

[22] Filed: Apr. 28, 1978

Related U.S. Application Data

[63] Continuation-in-part of Ser. No. 680,139, Apr. 26, 1976, abandoned.

[30] Foreign Application Priority Data

May 16, 1975 [SE] Sweden ..... 7505648

[51] Int. Cl.[3] ..... B03B 5/22

[52] U.S. Cl. ..... 209/268

[58] Field of Search ..... 209/267, 155, 156, 268, 209/158, 157

[56] References Cited

U.S. PATENT DOCUMENTS

| | | | |
|---|---|---|---|
| 2,853,191 | 9/1958 | Mogensen | 209/315 |
| 3,520,408 | 7/1970 | Schlebusch | 209/267 |

*Primary Examiner*—Hiram H. Bernstein

*Attorney, Agent, or Firm*—Toren, McGeady and Stanger

[57] ABSTRACT

A method for dividing a heterogeneous collection of ore particles prior to concentration thereof into groups differing in size and density of the particles by passing the particles in dispersion in a liquid through a space having obstacles therein which are arranged such that the sizes of the openings between the obstacles are always larger in size than the major number of particles arriving at the openings while simultaneously agitating the medium. This results in a variation of the path of the particles depending on their size and density and allows only the smaller and/or heavier particles to be brought to the concentration.

1 Claim, 3 Drawing Figures

METHOD OF PRE-CONCENTRATING HETEROGENEOUS MINERAL MIXTURES

CROSS-REFERENCE TO RELATED APPLICATIONS

This application is a continuation-in-part of application Ser. No. 680,139, filed on Apr. 26, 1976 and now abandoned.

BACKGROUND OF THE INVENTION

1. Field of the Invention

This invention pertains to the field of classification of ore particles for a subsequent concentration process.

2. Description of the Prior Art

An ore is a mixture of valuable ore minerals and less valuable gangue minerals. These minerals appear as crystals or grains in the solid ore body. Utilization of the ore is almost always combined with a concentration process or an ore dressing process which aims at recovering the valuable ore minerals from the ore.

In the concentration of an ore or a similar mixture of different substances, the first step usually is to crush or grind the mixture to particles. Grinding results in a collection of different types of particles, e.g., pure monogranular particles consisting of a single substance, and polygranular particles, which can consist of up to as many different substances as there are different mineral grains included in the particles.

The more the ore is ground, the finer are the particles, also in relation to the size of the crystals, and the higher is the degree of liberation or of difference in composition between polygranular mixed particles. Both these properties regulate the grade of the concentrate and the feasibility of the concentration process.

Grinding or crushing is an expensive process, and particularly expensive is the production of small particle sizes.

Additionally, very fine particles, e.g., slime, are also to be avoided because they disturb the concentration process. To diminish the production of slime, grinding is carried out in steps so that the ore is brought to a mill and ground, commonly in water, to a coarse size such that only a modest liberation is achieved. The ground material then goes to a dividing device that produces a fine product which has the desired liberation for the concentration process and a coarse product which is recirculated back to the mill, reground and then again brought to the dividing device. The fine product from this device has less slime than the ore would have had if ground directly to the desired liberation and the product has also been cheaper to make.

In most cases, classifiers are used as such a dividing device and operate on the principle that particles that are setting slowly, i.e. smaller and/or higher particles, are brought to the concentration process while particles falling more rapidly, i.e. larger and/or heavier particles, are returned to repeated grinding. Small, pure, heavy particles fall with the same velocity as larger, light mixed particles. The concentration process, therefore must operate with a particle mixture where the heavier material is in a more ground state than the lighter material. Pure, heavy particles are returned to the grinding device and come back often as a too finely ground slurry while light mixed particles, which would have needed to be additionally ground, are discharged to be concentrated.

If, instead, this dividing device were a conventional screen, the separation would take place according to particle size only, regardless of particle density. However, conventional screens are not sufficiently reliable at the fine size ranges in question; they are commonly used for relatively coarse separations, e.g., at 5 mm or more and are, therefore, rare in this context.

SUMMARY OF THE INVENTION

The present invention is based on the separation by particle size according to a probability method, in which the particle collection in a liquid is passed through a space having obstacles therein where the openings between the obstacles are of such a size that the predominant number of particles arriving at the openings can pass therethrough, whereby the formation of a bed by particles larger than the openings is avoided. Such a method is described, for example, in U.S. Pat. No. 2,853,191. It is normally possible by such methods to obtain reliable separations within substantially finer particle size ranges than within those where conventional sizing is applied.

In the present invention, the liquid is agitated while the particles are travelling between the obstacles. This subjects the particles to variations in acceleration forces due to direct collisions with other particles, with the obstacles, as well as due to the movements of the liquid, and heavier particles will be less affected than lighter ones of the same size. As a result, smaller and/or heavier particles will be less deviated when passing through the above mentioned space with obstacles than coarser and/or lighter ones; a dividing according to both particle size and particle density will take place.

The method of the present invention thus provides a process whereby heavier particles will be brought to the concentration process in a more coarsely ground state than when treated according to the known art; the process will be more efficient with less production of slime and improved economy.

DESCRIPTION OF THE PREFERRED EMBODIMENT

Figure 1A:
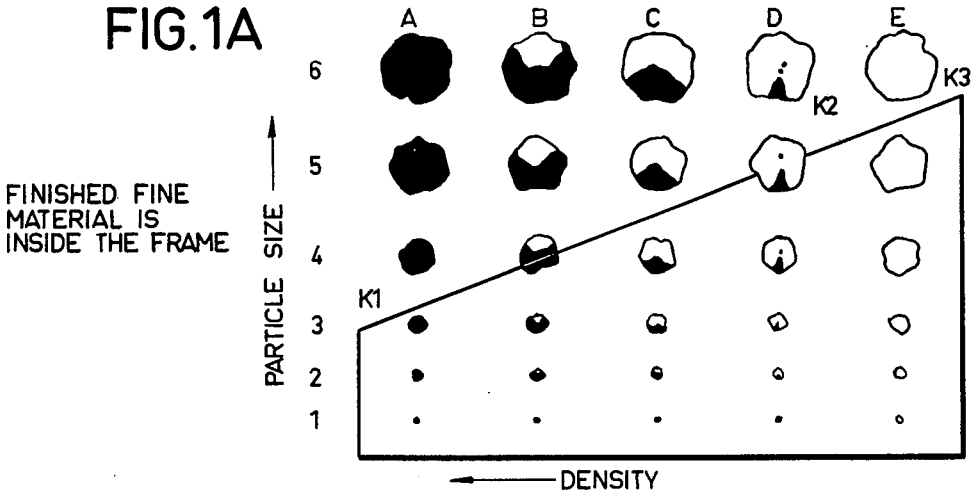
FIGS. 1A, 1B and 1C are explanatory diagrams of ore particles varying in size and ore concentration.

Referring to FIGS. 1A, B, and C, each of these figures depicts a series of particles ranging in size from numerical values 1 through 6, 6 being the largest, and 1 being the smallest, and ranging in density, A being the most dense, and E being the least dense. The black portion of the particles represents the valuable mineral in the particle so that consequently, the series of particles under the letter A are essentially composed of 100% of the valuable mineral and particles B through E have decreasing amounts of the valuable ore therein. Particles E are essentially composed of 100% gangue. Additionally, it is noted that an appropriate classifying device would be one which would produce two products, the first being a fine product which is ready for a subsequent concentration step and the second being a coarse product which would be recycled for regrinding.

FIG. 1A depicts the distribution that would be obtained in a classifier or apparatus which separates particles according to the difference in the falling velocity of different particles.

The line designated K1—K2—K3, indicates a line of a given falling velocity of the particles. Thus, it will be seen that a particle, such as A 3, would have about the same falling velocity as the considerably larger particle C 4, which is composed of both gangue and ore mineral. Also, the still larger but even lighter pure gangue particle E 5 would fall at the same rate. The particles underneath the line K1—K2—K3 will be directed to the concentration process whereas the heavier A particles which are coarser than size 3 will be rejected and recycled to the grinding process. However, light particles, such as E 5, will also go into the concentration process. This ultimately results in heavy material getting into the concentration process in a more finely ground stage than the lighter materials.

Figure 1B:
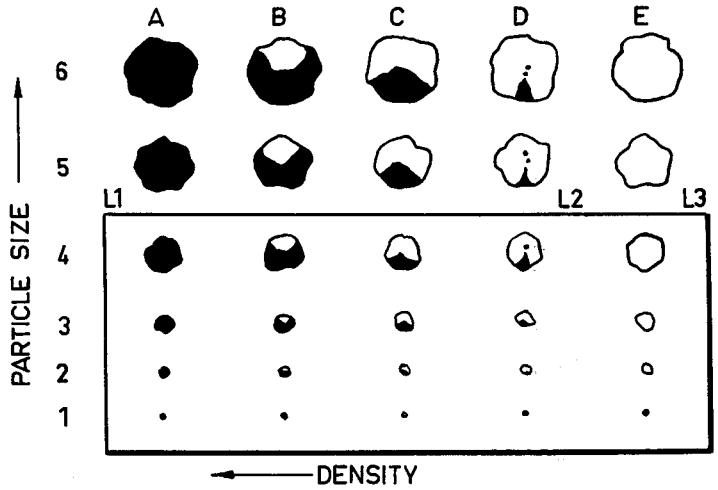

FIG. 1B depicts a method of separating the material utilizing conventional screening techniques.

A conventional screen would make a division only according to particle size. Thus, the dividing line would be depicted by the line L1—L2—L3, the mesh size of the screen being between particle sizes 4 and 5. All particles beneath this line would go to the concentration process and the particles above this line would be re-ground.

Figure 1C:
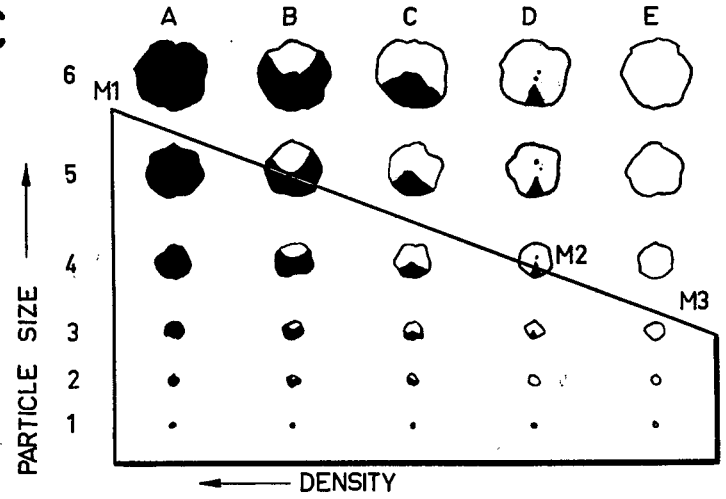

FIG. 1C represents a classification utilizing the process of the present invention. In this process, the heavier large particle A 5 which is essentially 100% ore mineral, will have the same probability to pass a given space with obstacles as the smaller and lighter (less rich) particles C 4 and E 3. Thus, a division will be made along the line M1—M2—M3 and it is thus clear that the particles below this line would go to the concentration whereas the larger particles above the line would go to regrinding. Consequently, by utilizing the process of the present invention, it is possible to include larger and heavier (pure) particles in the groups collected for sending to the concentration process whereas the larger particles, and, for the most part, less pure particles, would be sent to regrinding.

Figure 2:
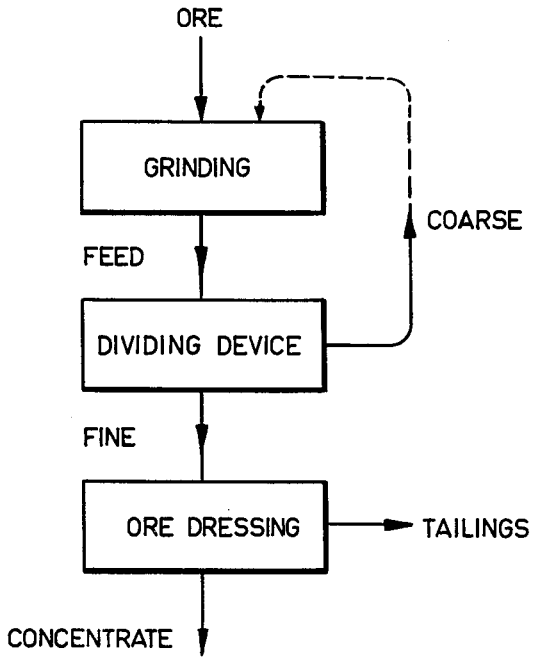
FIG. 2 is a flow sheet for closed circuit grinding and ore dressing.

FIG. 2 depicts a typical grinding and ore dressing process wherein ore is first sent to a grinding mill (herein sometimes referred to as "mill") and then to a dividing device. The finer materials then go on to the ore dressing process whereas the less fine materials from the dividing device are recycled back to the grinding mill.

A a mathematic study or clarifying example ground material is supposed to consist of five distinct particle sizes 1, 2, 3, 4 and 5. Each of these sizes has the same volume 320 units. Further, each size range consists of the following kinds of particles. It is further supposed that the ore mineral is twice as heavy as the gangue mineral:

| Kind of Particle | Percent by Volume | | Percent by Weight | |
|---|---|---|---|---|
| | Ore | Gangue | Ore | Gangue |
| A | 100 | 0 | 100 | 0 |
| B | 75 | 25 | 86 | 14 |
| C | 50 | 50 | 67 | 33 |
| D | 25 | 75 | 40 | 60 |
| E | 0 | 100 | 0 | 100 |

It is further considered that the different apparatuses are operating according to FIGS. 1A, 1B and 1C. This gives a considerable difference in the composition of of the finished product, that goes to the ore dressing already after the first passage through the mill. See tables 2 and 3 (table 3 is a resume of table 2).

TABLE 2

Distribution of different kinds of particles on the fine and in the coarse product from three different types of sizing device treating the ground product from a ball mill

| | | Volumes | | | | | Weights | | | | | Weights of Ore Mineral | | | | |
|---|---|---|---|---|---|---|---|---|---|---|---|---|---|---|---|---|
| | | A | B | C | D | E | A | B | C | D | E | A | B | C | D | E |
| Feed | 5 | 64 | 64 | 64 | 64 | 64 | 128 | 112 | 96 | 80 | 64 | 128 | 96 | 64 | 32 | 0 |
| | 4 | 64 | 64 | 64 | 64 | 64 | 128 | 112 | 96 | 80 | 64 | 128 | 96 | 64 | 32 | 0 |
| | 3 | 64 | 64 | 64 | 64 | 64 | 128 | 112 | 96 | 80 | 64 | 128 | 96 | 64 | 32 | 0 |
| | 2 | 64 | 64 | 64 | 64 | 64 | 128 | 112 | 96 | 80 | 64 | 128 | 96 | 64 | 32 | 0 |
| | 1 | 64 | 64 | 64 | 64 | 64 | 128 | 112 | 96 | 80 | 64 | 128 | 96 | 64 | 32 | 0 |
| | Σ | 320 | 320 | 320 | 320 | 320 | 640 | 560 | 480 | 400 | 320 | 640 | 480 | 320 | 160 | 0 |
| Classi- | 5 | 64 | 64 | 64 | 32 | 0 | 128 | 112 | 96 | 55 | 0 | 128 | 96 | 64 | 27 | 0 |
| fying | 4 | 64 | 44 | 0 | 0 | 0 | 128 | 77 | 0 | 0 | 0 | 128 | 66 | 0 | 0 | 0 |
| Coarse | 3 | 0 | 0 | 0 | 0 | 0 | 0 | 0 | 0 | 0 | 0 | 0 | 0 | 0 | 0 | 0 |
| | 2 | 0 | 0 | 0 | 0 | 0 | 0 | 0 | 0 | 0 | 0 | 0 | 0 | 0 | 0 | 0 |
| | 1 | 0 | 0 | 0 | 0 | 0 | 0 | 0 | 0 | 0 | 0 | 0 | 0 | 0 | 0 | 0 |
| | Σ | 128 | 108 | 64 | 32 | 0 | 256 | 189 | 96 | 55 | 0 | 256 | 162 | 64 | 27 | 0 |
| Fine | 5 | | | | 32 | 64 | | | | 25 | 64 | | | | 5 | 0 |
| | 4 | | 20 | 64 | 64 | 64 | | 35 | 96 | 80 | 64 | | 30 | 64 | 32 | 0 |
| | 3 | 64 | 64 | 64 | 64 | 64 | 128 | 112 | 96 | 80 | 64 | 128 | 96 | 64 | 32 | 0 |
| | 2 | 64 | 64 | 64 | 64 | 64 | 128 | 112 | 96 | 80 | 64 | 128 | 96 | 64 | 32 | 0 |
| | 1 | 64 | 64 | 64 | 64 | 64 | 128 | 112 | 96 | 80 | 64 | 128 | 96 | 64 | 32 | 0 |
| | Σ | 192 | 212 | 256 | 288 | 320 | 384 | 371 | 384 | 345 | 320 | 384 | 318 | 256 | 133 | 0 |
| Screening | 5 | 64 | 64 | 64 | 64 | 64 | 128 | 112 | 96 | 80 | 64 | 128 | 96 | 64 | 32 | 0 |
| | 4 | 0 | 0 | 0 | 0 | 0 | 0 | 0 | 0 | 0 | 0 | 0 | 0 | 0 | 0 | 0 |
| Coarse | 3 | 0 | 0 | 0 | 0 | 0 | 0 | 0 | 0 | 0 | 0 | 0 | 0 | 0 | 0 | 0 |
| | 2 | 0 | 0 | 0 | 0 | 0 | 0 | 0 | 0 | 0 | 0 | 0 | 0 | 0 | 0 | 0 |
| | 1 | 0 | 0 | 0 | 0 | 0 | 0 | 0 | 0 | 0 | 0 | 0 | 0 | 0 | 0 | 0 |
| | Σ | 64 | 64 | 64 | 64 | 64 | 128 | 112 | 96 | 80 | 64 | 128 | 96 | 64 | 32 | 0 |
| Fine | 5 | | | | | | | | | | | | | | | |
| | 4 | 64 | 64 | 64 | 64 | 64 | 128 | 112 | 96 | 80 | 64 | 128 | 96 | 64 | 32 | 0 |
| | 3 | 64 | 64 | 64 | 64 | 64 | 128 | 112 | 96 | 80 | 64 | 128 | 96 | 64 | 32 | 0 |

TABLE 2-continued

| | | Distribution of different kinds of particles on the fine and in the coarse product from three different types of sizing device treating the ground product from a ball mill | | | | | | | | | | | | | | |
|---|---|---|---|---|---|---|---|---|---|---|---|---|---|---|---|---|
| | | Volumes | | | | | Weights | | | | | Weights of Ore Mineral | | | | |
| | | A | B | C | D | E | A | B | C | D | E | A | B | C | D | E |
| | 2 | 64 | 64 | 64 | 64 | 64 | 128 | 112 | 96 | 80 | 64 | 128 | 96 | 64 | 32 | 0 |
| | 1 | 64 | 64 | 64 | 64 | 64 | 128 | 112 | 96 | 80 | 64 | 128 | 96 | 64 | 32 | 0 |
| | Σ | 256 | 256 | 256 | 256 | 256 | 512 | 448 | 384 | 320 | 256 | 512 | 384 | 256 | 128 | 0 |
| Separation | 5 | 0 | 32 | 64 | 64 | 64 | 0 | 56 | 96 | 80 | 64 | 0 | 48 | 64 | 32 | 0 |
| According | 4 | 0 | 0 | 0 | 40 | 64 | 0 | 0 | 0 | 50 | 64 | 0 | 0 | 0 | 20 | 0 |
| to Invention | 3 | 0 | 0 | 0 | 0 | 0 | 0 | 0 | 0 | 0 | 0 | 0 | 0 | 0 | 0 | 0 |
| Coarse | 2 | 0 | 0 | 0 | 0 | 0 | 0 | 0 | 0 | 0 | 0 | 0 | 0 | 0 | 0 | 0 |
| | 1 | 0 | 0 | 0 | 0 | 0 | 0 | 0 | 0 | 0 | 0 | 0 | 0 | 0 | 0 | 0 |
| | Σ | 0 | 32 | 64 | 104 | 128 | 0 | 56 | 96 | 130 | 128 | 0 | 48 | 64 | 52 | 0 |
| Fine | 5 | 64 | 32 | | | | 128 | 56 | | | | 128 | 48 | | | |
| | 4 | 64 | 64 | 64 | 24 | | 128 | 112 | 96 | 30 | | 128 | 96 | 64 | 12 | |
| | 3 | 64 | 64 | 64 | 64 | 64 | 128 | 112 | 96 | 80 | 64 | 128 | 96 | 64 | 32 | 0 |
| | 2 | 64 | 64 | 64 | 64 | 64 | 128 | 112 | 96 | 80 | 64 | 128 | 96 | 64 | 32 | 0 |
| | 1 | 64 | 64 | 64 | 64 | 64 | 128 | 112 | 96 | 80 | 64 | 128 | 96 | 64 | 32 | 0 |
| | Σ | 320 | 288 | 256 | 216 | 192 | 640 | 504 | 384 | 270 | 192 | 640 | 432 | 256 | 108 | 0 |

TABLE 3

| | Distribution of products at three different types of division | | | |
|---|---|---|---|---|
| | Volume of products % | Weight of products % | Weight of are mineral and distribution of it % | Grade of are mineral in the products % |
| Feed | 100.0 | 100.0 | 100.0 | 66.7 |
| Classifying | | | | |
| Coarse | 20.7 | 24.8 | 31.8 | 85.3 |
| Fine | 79.3 | 75.2 | 68.2 | 60.5 |
| Feed | 100.0 | 100.0 | 100.0 | |
| Screening | | | | |
| Coarse | 20.0 | 20.0 | 20.0 | 66.7 |
| Fine | 80.0 | 80.0 | 80.0 | 66.7 |
| Feed | 100.0 | 100.0 | 100.0 | |
| Separation According to Invention "Wet Sizing" | | | | |
| Coarse | 20.5 | 17.1 | 10.2 | 40.0 |
| Fine | 79.5 | 82.9 | 89.8 | 68.3 |
| Feed | 100.0 | 100.0 | 100.0 | |

Comments to Table 2

The three methods extract about the same volumes of fines, about 80%. However, the concentrating effect of the present invention makes the fines fraction heavier.

When these different products from the grinding systems are concentrated, the differences become even more evident.

Assuming that the concentrating process attracts every particle containing the ore mineral, i.e., only the particles in the E column being removed as tailing after the first passage through the grinding system, the following products will be obtained at:

classifying 62% concentrate with 74% ore mineral with 68% recovery, screening 69% concentrate with 77% ore mineral with 80% recovery, wet sizing 75% concentrate with 80% ore mineral with 90% recovery. (present invention)

While this calculation is only for demonstration, other values could be presumed, for instance, that both D and F particles go off as tailing, and the results would be essentially the same.

It should be noted, that while the screening, which operates only according to particle size, maintains the grade of the feed (66.7%) in the products, the classifying reduces it (60.5) and the wet sizing increases it (68.3).

Having thus described the invention, what is claimed is:

1. A method for dividing a heterogeneous collection of particles, which differ from one another in particle size and density, into groups differing in size and density comprising forming a dispersion of the particles in water and passing the dispersion downwardly through an overall space, said overall space having obstacles therein which are arranged such that the sizes of the spaces between the obstacles are always larger in size than the major number of particles arriving at said spaces and simultaneously agitating the water, whereby the particles are subject to variations in acceleration forces due to direct collision with other particles and the obstacles and movement of the water such that said varying acceleration forces change the path of said particles through said overall space, the change in path being (a) less for a particle of equal size but greater weight than another particle, and (b) less for a particle of equal weight but greater size than another particle, and collecting the particles in different groups dependent upon said group path through said overall space.

* * * * *